US011318632B2

(12) United States Patent
Efthimiadis et al.

(10) Patent No.: US 11,318,632 B2
(45) Date of Patent: May 3, 2022

(54) RAZOR SYSTEM

(71) Applicant: BIC-VIOLEX S.A., Anixi (GR)

(72) Inventors: Dimitrios Efthimiadis, Athens (GR); Panagiotis Kopelas, Dafni-Athens (GR)

(73) Assignee: BIC-VIOLEX SA, Anixi (GR)

( * ) Notice: Subject to any disclaimer, the term of this patent is extended or adjusted under 35 U.S.C. 154(b) by 288 days.

(21) Appl. No.: 16/303,361

(22) PCT Filed: Jun. 16, 2017

(86) PCT No.: PCT/EP2017/064846

§ 371 (c)(1),
(2) Date: Nov. 20, 2018

(87) PCT Pub. No.: WO2018/007132

PCT Pub. Date: Jan. 11, 2018

(65) Prior Publication Data

US 2020/0316801 A1 Oct. 8, 2020

Related U.S. Application Data

(60) Provisional application No. 62/358,670, filed on Jul. 6, 2016.

(51) Int. Cl.
*B26B 21/56* (2006.01)
*B26B 21/40* (2006.01)

(52) U.S. Cl.
CPC ..... *B26B 21/565* (2013.01); *B26B 21/4012* (2013.01); *B26B 21/4068* (2013.01)

(58) Field of Classification Search
CPC ..... B26B 21/02; B26B 21/04; B26B 21/06; B26B 21/14; B26B 21/16; B26B 21/165; B26B 21/227; B26B 21/4031; B26B 21/56; B26B 21/565; B26B 21/4068; B26B 21/4012; B26B 21/40
USPC ..... 30/47–51
See application file for complete search history.

(56) References Cited

U.S. PATENT DOCUMENTS 3,863,340 A * 2/1975 Perry ..... B65D 83/10 30/346.58
3,949,470 A * 4/1976 Hall ..... B26B 21/22 30/50
4,200,976 A * 5/1980 Gooding ..... B26B 21/222 219/121.13

(Continued)

FOREIGN PATENT DOCUMENTS

EP 2559526 A1 * 2/2013 ..... B26B 21/22
EP 2 707 180 B1 12/2016
WO 2012/158141 A1 11/2012

OTHER PUBLICATIONS

International Search Report for PCT/EP2017/064846 dated Sep. 19, 2017.

*Primary Examiner* — Nhat Chieu Q Do
(74) *Attorney, Agent, or Firm* — Polsinelli PC

(57) ABSTRACT

A cutting member for a shaving cartridge is provided that includes a flat cutting portion, a bent portion, and a base portion. The flat cutting portion has a front cutting-edge portion. The bent portion is intermediate to the base portion and the flat cutting portion. The bent portion and the base portion are made out of one single piece of material. The bent portion is arranged such that it is adjacent to the front cutting portion. The proposed shape of the cutting member resembles a reverse L.

10 Claims, 5 Drawing Sheets

(56) References Cited

U.S. PATENT DOCUMENTS

| | | | | |
|---|---|---|---|---|
| 8,104,179 | B2 * | 1/2012 | Nakasuka | B26B 21/4068 30/50 |
| 2005/0198840 | A1 * | 9/2005 | Worrick, III | B26B 21/4075 30/527 |
| 2008/0066315 | A1 * | 3/2008 | Xu | B26B 21/565 30/50 |
| 2010/0011588 | A1 * | 1/2010 | Wang | B26B 21/4031 30/41 |
| 2010/0154222 | A1 * | 6/2010 | Nakasuka | B26B 21/225 30/50 |
| 2010/0229397 | A1 * | 9/2010 | Nakasuka | B26B 21/227 30/50 |
| 2011/0232100 | A1 * | 9/2011 | Park | B26B 21/28 30/50 |
| 2012/0317818 | A1 * | 12/2012 | Oglesby | B26B 21/4031 30/77 |
| 2013/0205595 | A1 | 8/2013 | Bykowski et al. | |
| 2015/0283715 | A1 * | 10/2015 | Stephens | B26B 21/443 30/41 |

* cited by examiner

RAZOR SYSTEM

CROSS REFERENCE TO RELATED APPLICATION

The application is a National Stage application of International Application No. PCT/EP2017/064846, filed Jun. 16, 2017, now published as WO 2018/007132 A1 and which claims priority to U.S. 62/358,670, filed Jul. 6, 2016, the entire contents of each is incorporated herein by reference.

FIELD

The disclosure relates to cutting members for shaving cartridges and to the process for manufacturing a cutting member for a shaving cartridge and to blade supports. More particularly, the disclosure relates to a unique and specific shape of the cutting member for shaving cartridges.

BACKGROUND

The current design of shaving razors includes one or more blades placed within the housing that is attached to a handle. The housing and the blades together form a razor cartridge. Generally, a blade is welded to a support, and the blade and the support together forming a cutting member. Many razor cartridges have used movable blades, where the cutting member is allowed to move inside the housing upon shaving. When number of blades within a single cartridge increase, the space available for water and cut hair material to flow through the cartridge is decreased for a given razor cartridge footprint. Efforts to enhance rinsability has led to providing thinner blades which, in turn, is difficult because of the mechanical stress encountered by the blade.

According to current designs of the support of movable blades, the loading of the blades is focused on the center of the blade thereby creating a need for supporting features in the housing. While rinsability is much better with the movable blades design, the use of thinner supports or integral bent blades requires additional supporting features on the housing, resulting in the creation of more blocked areas.

The supporting features of the housing create additional "obstacles" within the shaving head and therefore the rinsability of the head is greatly decreased, leading to debris accumulation and early blade dulling. Also, the forces applied on the blade during shaving (for a shaving head with specific dimensions) limits how thin the support and blade body can be. The forces, in addition to the degree of freedom of the blade in the housing, make the blades move upwards and backwards in the housing, increasing the possibility of nicks and cuts as the blades are becoming more aggressive.

SUMMARY

The present disclosure relates to providing a cutting member for a shaving cartridge having a specific design leading to an improved shaving performance; to providing a blade support of a unique shape; and to providing a process for manufacturing the uniquely shaped cutting members for shaving cartridges.

More particularly, aspects of the disclosure may include a cutting member for a shaving cartridge wherein the cutting member may include a flat cutting portion, a bent portion, and a base portion. The flat cutting portion may include a front cutting-edge portion wherein the flat cutting portion may define a cutting portion plane. The bent portion may be intermediate to the flat cutting portion and the base portion. At least the bent portion and the base portion may be made out of one single piece of material. The cutting member may be designed such that the bent portion may be adjacent to the front cutting-edge portion.

Effect of the Disclosure

According to the present description, a cutting member for a shaving cartridge of a unique design leads to a blade being less aggressive to the user's skin and follows the skin contours more closely compared to the conventional shaving cartridge. This results in reduction of unwanted nicks and cuts and overall improved shaving performance. According to some embodiments, such new support design may allow using thinner blades and also a thinner support. Therefore, the manufacturing process is faster, more efficient, and the overall cost of production could be possibly reduced.

BRIEF DESCRIPTION OF THE DRAWINGS

While the disclosure concludes with claims particularly pointing out and distinctly claiming the subject matter which is regarded as forming the present concept, it is believed that the concept will be better understood from the following description which is taken in conjunction with the accompanying drawings in which like designations are used to designate substantially identical elements.

DETAILED DESCRIPTION

Figure 1:
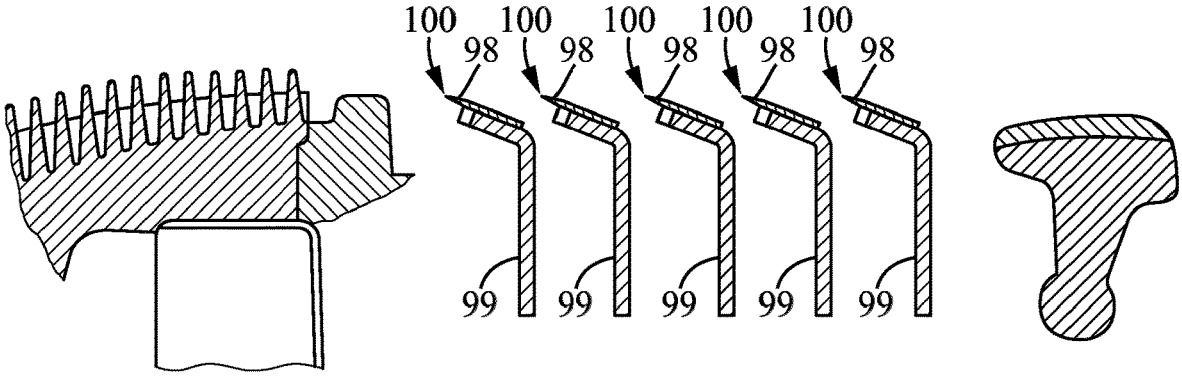
FIG. 1 Prior Art
FIG. 1 is a cross-sectional view of the conventional shaving head, blade and blade support.

It is to be understood that the present concept is not limited in its application to the details of construction and to the embodiments of the components set forth in the following description or illustrated in the drawings. The figures and written description are provided to teach any person skilled in the art to make and use the inventions for which patent protection is sought. The present concept is capable of other embodiments and of being practiced and carried out in various ways. Persons of skill in the art will appreciate that the development of an actual commercial embodiment incorporating aspects of the present concept will require numerous implementations—specific decisions to achieve the ultimate goal of the developer for the commercial embodiment. While these efforts may be complex and time-consuming, these efforts nevertheless would be a routine undertaking for those of skill in the art of having the benefit of this disclosure.

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," "side," are used in the description for clarity in specific reference to the figures and are not intended to limit the scope of the present concept or the appended claims. Further, it should be understood that any one of the features of the present concept may be used separately or in combination with other features. Other systems, methods, features, and advantages of the present concept will be or become apparent to one with skill in the art upon examination of the figures and the detailed description. It is intended that all such additional systems, methods, features, and advantages be included within this description, be within the scope of the present concept, and be protected by the accompanying claims.

Further, any term of degree such as, but not limited to, "substantially," as used in the description and the appended claims, should be understood to include an exact or a comparable but not exact configuration. For example, "substantially" shaped means having an exact shape or a comparable shape, but not exact shape. Likewise, "substantially L" shaped means having an exact "L" shape or a comparable but not exact "L" shape. Also, "a substantially planar surface" means having an exact planar surface or a comparable, but not exact planar surface. Similarly, the terms "about" or "approximately," as used in the description and the appended claims, should be understood to include the recited values or a value that is greater or less than the recited value by a percentage which is settable by the person skilled in the art in view of the context. For example, it would be a percentage of twenty percent greater or less than the recited values. For example, about 10 millimeters includes all values from 8 millimeters to 12 millimeters, and approximately 50 degrees includes all values from 40 degrees to 60 degrees.

Further, as the present concept is susceptible to embodiments of many different forms, it is intended that the present disclosure be considered as an example of the principles of the present concept and not intended to limit the present concept to the specific embodiments shown and described. Any one of the features of the present concept may be used separately or in combination with any other feature. References to terms "embodiment," "embodiments," and/or the like in the description mean that the feature and/or features being referred to are included in at least one aspect of the description. Separate references to terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments but is not necessarily included. Thus, the present concept may include a variety of combinations and/or integrations of the embodiments described herein. Additionally, all aspects of the present disclosure, as described herein, are not essential for its practice. Likewise, other systems, methods, features, and advantages of the present concept will be or become apparent to one with skill in the art upon examination of the figures and the description. It is intended that all such additional systems, methods, features, and advantages be included within this description, be within the scope of the present concept, and be encompassed by the claims.

In the figures, the same references denote identical or similar elements.

Figure 2:
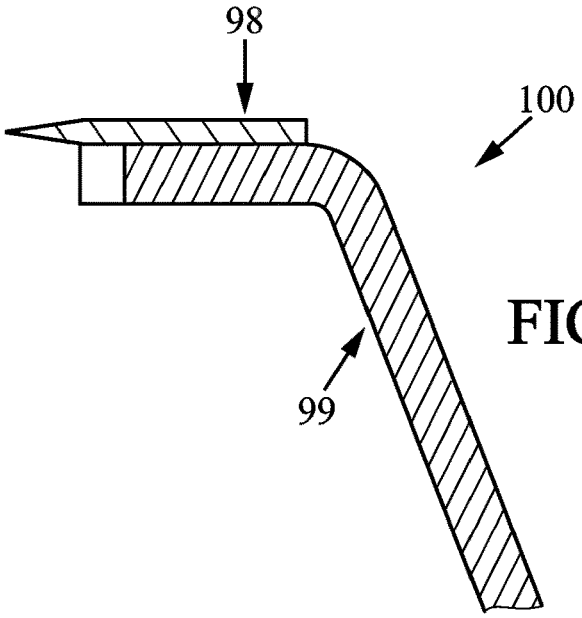
FIG. 2 Prior Art
FIG. 2 is a vertical cross-sectional view of the conventional blade and blade support of FIG. 1.

FIG. 1 details a conventional shaving cartridge head equipped with a plurality of blades ("cutting portions") arranged within a housing. The blades are mounted on a respective elongated support. FIG. 2 details the blade and blade support assembly. More particularly, FIG. 2 details a blade 98 and a blade support 99, together forming the blade and blade support assembly 100. In the conventionally used blade and blade support assembly 100, the blade support 99 is approximately 0.28 mm thick.

Figure 3:
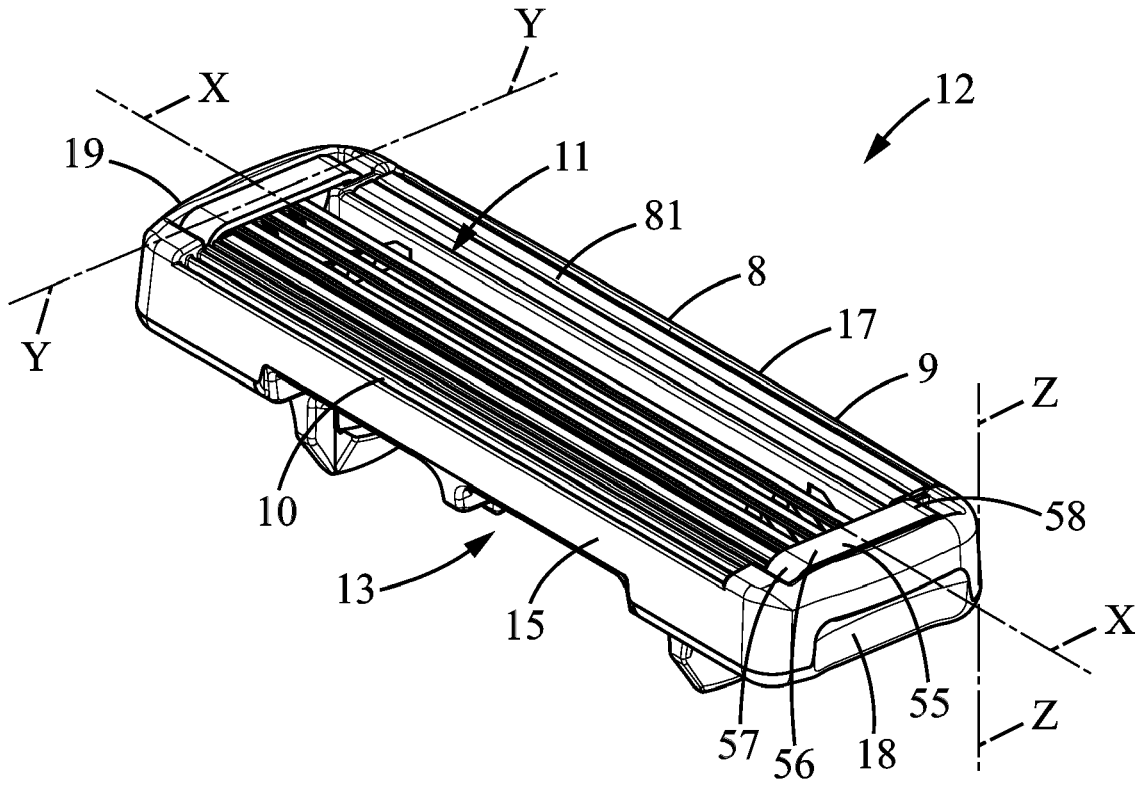
FIG. 3 is a perspective view of the shaving cartridge according to aspects of the present disclosure.
Figure 4:
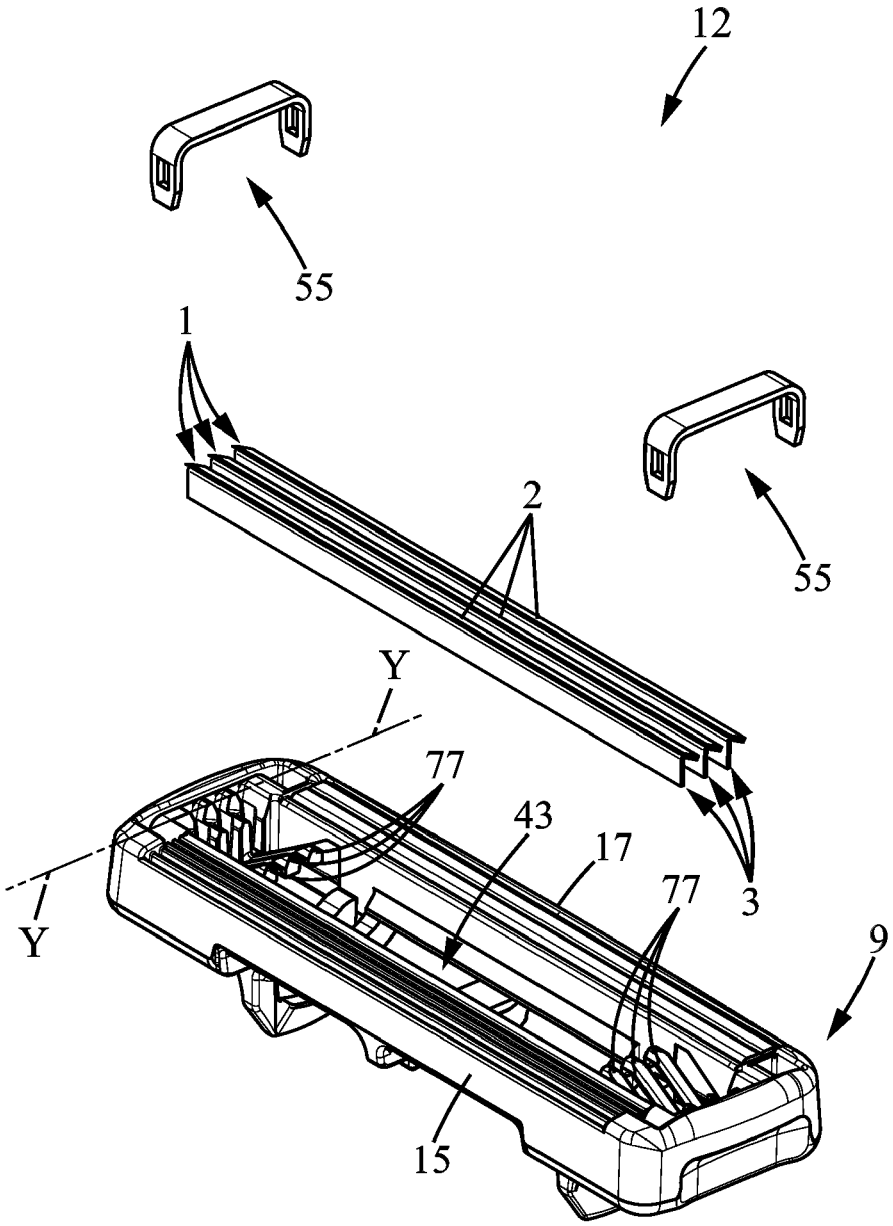
FIG. 4 is an exploded perspective view of the shaving cartridge of FIG. 3.

Aspects of the disclosure may include a shaving cartridge 12 including a housing 9. The housing 9 may extend in a longitudinal direction, along an X-X axis. Referring to FIGS. 3 and 4, the housing 9 may be formed in a conventional rectangular shape. However, according to some aspects, the housing 9 may also have different shapes, for example an oval shape.

As further detailed in FIG. 4, the housing 9 may have a top portion 11, a bottom portion 13 opposing said top portion 11, a front portion 15, and a rear portion 17 opposing the front portion 15. The top portion 11 and the bottom portion 13 of the housing may be parallel to each other. The front portion 15 and the rear portion 17 may face each other and may include a plurality of side portions 18, 19. The front portion 15 and the rear portion 17 may extend in a lateral direction along a lateral axis Z-Z, between the top portion 11 and the bottom portion 13 of the housing. The lateral axis Z-Z may intersect the longitudinal axis X-X and may be perpendicular to the longitudinal axis X-X. The plurality of side portions 18, 19 may have a first side portion 18 and a second side portion 19. The first side portion 18 and the second side portion 19 may extend between the front portion 15 and the rear portion 17 of the housing in a transverse direction, along a transverse axis Y-Y. The two side portions 18, 19 may also form an angle with the front and rear portions 15, 17, or with the top and bottom portions 11, 13. The transverse axis Y-Y may be orthogonal to the longitudinal axis X-X and to the lateral axis Z-Z.

The housing 9 may be made out of plastic material. Also, any other materials may be used as well. The housing 9 may be made also out of a combination of two or more different materials. The housing 9 may also include a connecting mechanism which may allow the shaving cartridge 12 to be connected to a handle.

The housing 9 may include a guard bar 10 adjacent to the front portion 15 of the housing and a cap 8 adjacent to the rear portion 17 of the housing. The cap 8 may include a lubricating strip 81 which may be oriented upward and configured to come into contact with the skin of a user during the shaving process.

The housing 9 may include a blade receiving portion 43. The blade receiving portion 43 may be arranged on the top portion 11 of the housing, between the front portion 15 and the rear portion 17 of the housing. The blade receiving portion 43 may define a recess and may be configured to receive at least one cutting member 1, 121. The at least one cutting member 1, 121 may be mounted in the blade receiving portion 43 between the front portion 15 of the housing and the rear portion 17 of the housing and between the plurality of side portions 18, 19 of the housing. Each cutting member 1, 121 may extend in the longitudinal direction along the longitudinal axis X-X. The blade receiving portion 43 may have a conventional rectangular shape.

Figure 5:
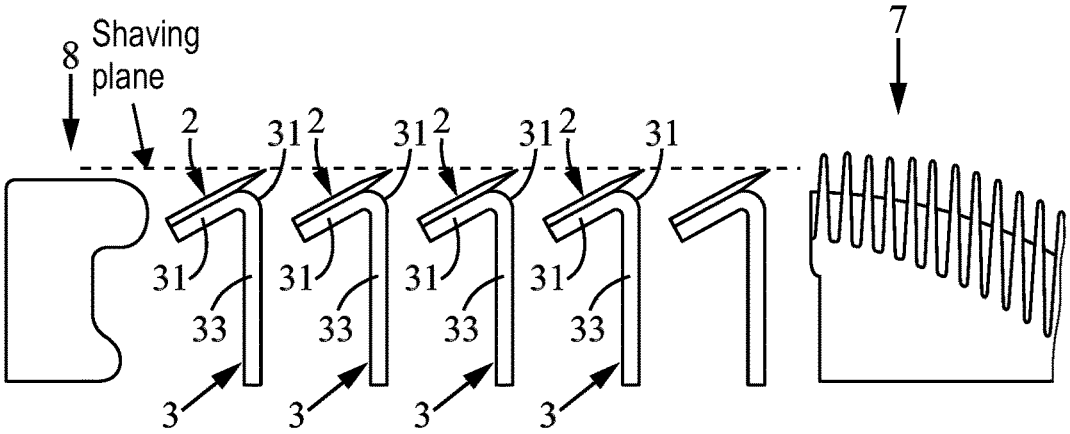
FIG. 5 is an exploded cross-sectional view of the shaving cartridge and cutting members of FIG. 3.

The at least one cutting member 1, 121 may include a flat cutting portion 2, a bent portion 32, and a base portion 33. The shaving cartridge 12 may include three cutting members 1, 121. According to other aspects, the cutting members 1, 121 may include more or less than three cutting members 1, 121. As detailed in FIG. 5, the shaving cartridge 12 may include, for example, five cutting members 1, 121. The quantity of the cutting members 1, 121 in the shaving cartridge 12 may vary.

The cutting member 1, 121 may be formed such that at least the bent portion 32 and the base portion 33 may be made out of one single piece of material.

The at least one cutting member 1, 121 may be movably mounted along the lateral axis Y-Y in the blade receiving portion 43. For example, the cutting member 1, 121 may be carried by two elastic fingers 77. The elastic fingers 77, as illustrated in FIG. 4, may extend in the blade receiving portion 43 towards each other and upwardly from each one of the plurality of side portions 18, 19 of the housing.

The at least one cutting member 1, 121 may be retained in the housing by retaining members 55. A retaining member 55 may be, for example, a clip. The clip 55 may have a regular U shape and may include a body 56 and at least two legs 57, 58. The body 56 of the clip may extend between the at least to legs 57, 58 and along the transversal axis Y-Y. The clip 55 may be located to face the front cutting-edge portion 21 of the flat cutting portion 2 and may retain the cutting member 1, 121 in the housing 9. According to other aspects, the cutting members 1, 121 may be retained on the housing by retainers or by an ultrasonic welded cap.

According to some aspects, the flat cutting portion 2 may be exposed via the top portion 11 of the housing. The flat cutting portion 2 of the cutting member 1 may be at least one blade. The blade may be made out of metal material. According to some aspects, other materials may be used as well, for example, ceramics. The flat cutting portion 2 may extend in the longitudinal direction, along the longitudinal axis X-X. The flat cutting portion 2 may have a front cutting-edge portion 21 and a rear end 22 opposite to the front cutting-edge portion 21. The front cutting-edge portion 21 may be accessible at the top portion 11 of the housing 9 to cut the hair during the shaving process. The flat cutting portion 2 may define a cutting portion plane.

Figure 6:
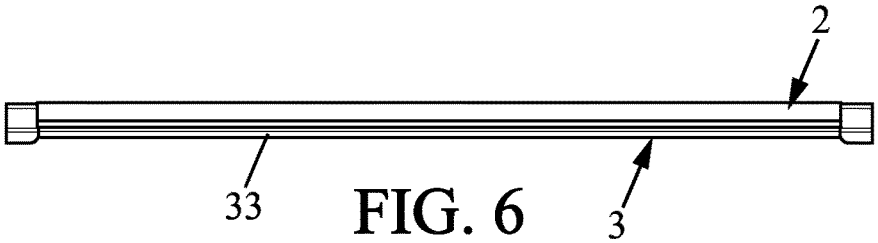
FIG. 6 is a top view of the cutting member of FIG. 3.
Figure 7:
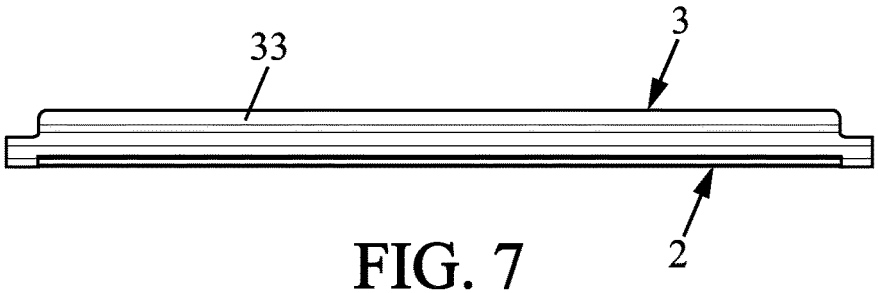
FIG. 7 is a front view of the cutting member FIG. 6.
Figure 8:
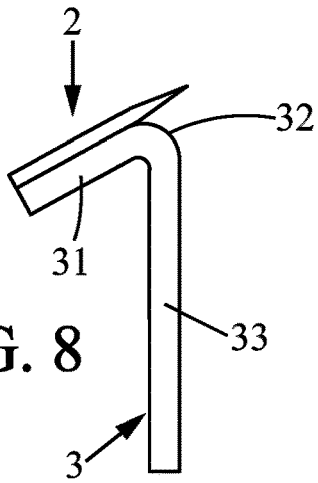
FIG. 8 is a side sectional view of the cutting member of FIG. 6.

Referring to FIGS. 6-8, each flat cutting portion 2 may be supported; respectively, on a support portion 3. The support portion 3 may include the base portion 33, the bent portion 32, and a platform portion 31 to which the flat cutting portion 2 may be mounted. The flat cutting portions 2 may be attached to the support portion 3 by welding techniques or any other techniques such as gluing or adhesives may be used.

The support portion 3 may be profiled along the axis X-X. Hence, the geometry of the support portion 3 may be substantially similar along the axis X-X. The platform portion 31 may extend between the bent portion 32 and the rear end 22 of the flat cutting portion and extends towards the bent portion 32. The platform portion 31 may be connected to the flat cutting portion 2. The platform portion 31 may include an end portion 311. The platform portion 31 may be made out of one single piece of material with the bent portion 32 and the base portion 33. The base portion 33 may extend downward from the bent portion 32. The bent portion 32 may be intermediate to the platform portion 31 and the base portion 33 and may extend between the platform portion 31 and the base portion 33. The end portion 311 may be arranged to be adjacent to the rear end 22 of the flat cutting portion.

Figure 9:
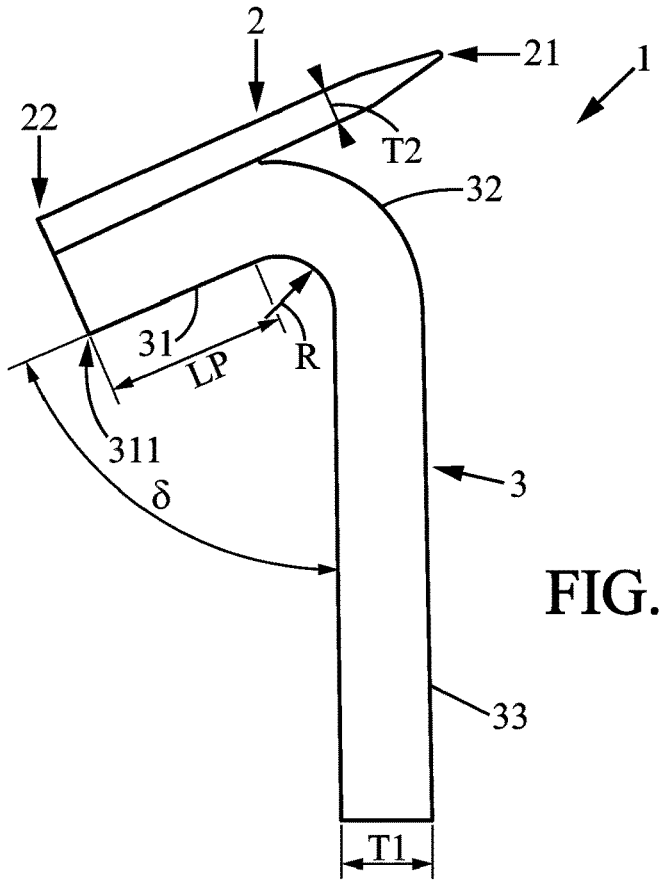
FIG. 9 is an enlarged vertical cross-sectional view of the cutting member of FIG. 6.

As shown in FIG. 9, the shape of the support portion 3 resembles a reverse L. By "reverse", it is meant that, along this orientation, the "L" may be rotated by 180°. The reverse L support portion 3 may lead to less aggressive blades, because of the downwards and backwards movement of the blades during shaving, resulting in fewer unwanted nicks and cuts, and better fluidity. The contours of the skin of the user may be followed more closely and may lead to overall improved shaving performance relative to the conventional shaving cartridges. The reverse L-shaped support portion 3 may allow for the use of thinner blades and also thinner blade supports. Consequently, the cost of production may be decreased.

The support portion 3 may be made out of various materials, such as metal material(s). A thickness T1 of the support portion 3 may be between 0.07 mm and 0.18 mm. According to some aspects, the thickness T1 may be between 0.10 mm and 0.15 mm and according to further aspects, may be about 0.12 mm.

Referring to FIG. 9, the bent portion 32 may include an inner radius of curvature R, also called "radius of curvature", that may be between 0.1 mm and 0.3 mm. According to some aspects, the inner radius of curvature R may be between 0.15 mm and 0.25 mm, and according to some aspects, about 0.2 mm.

The platform portion 31 may extend at an angle δ of 45° to 90° relative to the base portion 33. According to some aspects, the angle δ may be between 50° to 80°, and according to further aspects the angle δ may be about 70°. In particular, with the support portion 3 extending along the same orientation in the housing 9 as the support portion 3 of the typical prior art cartridges, the orientation of the cutting member 1 may be similar to the orientation of the cutting member of this typical prior art cartridge.

The platform portion 31 of the support portion 3 may be between 0.2 mm and 1.5 mm in length from the end portion 311 and the bent portion 32. According to some aspects, the platform portion 31 may be about 0.4 mm to 1.0 mm, and according to further aspects, about 0.5 mm in length LP from the end portion 311 and the bent portion 32.

A thickness T2 of the flat cutting portion 2 of the cutting member may be between 0.04 mm and 0.11 mm. According to other aspects, the thickness T2 may be about 0.1 mm.

According to aspects where flat cutting portion 2 may be supported on the support portion 3, the support portion 3 may be carried by the elastic fingers 77.

Figure 10:
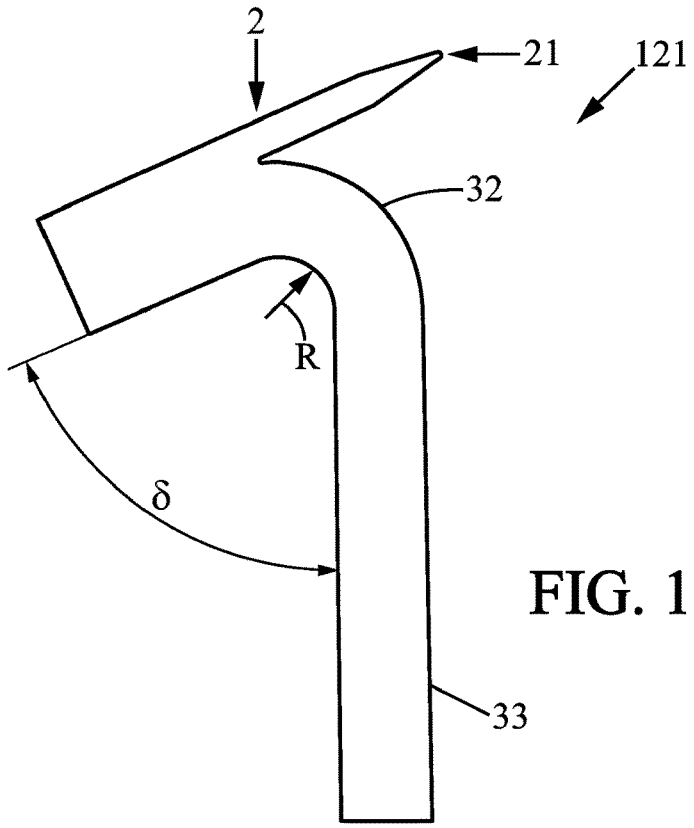
FIG. 10 is a vertical cross-sectional view of another aspect of the cutting member of the present disclosure.

According to further aspects of the disclosure, the cutting member 121 may include the flat cutting portion 2, the bent portion 32, and the base portion 33, as detailed in FIG. 10. The flat cutting portion 2 may be exposed via the top portion 11 of the housing 9. The flat cutting portion 2 may extend in the longitudinal direction, along the longitudinal axis X-X.

The flat cutting portion 2 may include the front cutting-edge portion 21 being accessible at the top portion 11 of the housing 9 to cut the hair during the shaving process. The flat cutting portion 2 may define the cutting portion plane. The flat cutting portion 2 may be made out of one single piece of material with the bent portion 32 and the base portion 33. The base portion 33 may extend downward from the bent portion 32. The bent portion 32 may be intermediate to the flat cutting portion 2 and the base portion 33 and may extend between the flat cutting portion 2 and the base portion 33. The bent portion 32 may be adjacent to the front cutting-edge portion 21. In other words, the bent portion 32 may be oriented towards the front portion 15 of the housing where the guard bar 10 may be present.

The shape of the cutting member 121 may resemble a reverse L. By "reverse", it is meant that, along this orientation, the "L" may be rotated by 180°. The newly designed cutting member 121 may lead to the less aggressive profile resulting in fewer unwanted nicks and cuts, and better fluidity. The contours of the skin of the user may be followed more closely and may lead to an overall improved shaving performance relative to the conventional shaving cartridges.

The bent portion 32 may have an inner radius of curvature R, also called "radius of curvature", that may be between 0.1 mm and 0.3 mm. According to some aspects, the inner radius of curvature R may be between 0.15 mm and 0.25 mm, and according to further aspects, about 0.2 mm.

The flat cutting portion 2 may extend at the angle δ of 45° to 90° relative to the base portion 33. According to some aspects the angle δ may be about 50° to 80°, and according to further aspects the angle δ may be about 70°.

A process for manufacturing a cutting member 1, 121 for a shaving cartridge 12 may include the following steps:

providing at least a piece of material;

forming a flat cutting portion 2 having a front cutting-edge portion 21, a bent portion 32, and a base portion 33; wherein the bent portion 32 may be between the flat cutting portion 2 and the base portion 33; and wherein the bent portion 32 may be adjacent to the front cutting-edge portion 21.

The process may further include the following steps:

forming a platform portion 31 having an end portion 311 and being made out of one single piece of material with the bent portion 32 and the base portion 33; wherein the platform portion 3 may extend towards to the bent portion 32; wherein the flat cutting portion 2 may further include a rear end 22 opposite to the cutting-edge portion 21; and assembling the flat cutting portion 2 on the platform portion 31 such that the end portion 311 may be adjacent to the rear end 22.

The process may further include one or more of the following features:

the one single piece of material may preferably b e between 0.07 mm and 0.18 mm, according to some aspects, the single piece of material may be between 0.10 mm and 0.15 mm and according to further aspects, about 0.12 mm;

a radius of curvature R of the bent portion 32 may be between 0.1 mm and 0.3 mm, according to some aspect, between 0.15 mm and 0.25 mm, and according to further aspects, about 0.2 mm;

the flat cutting portion 2 may extend at an angle δ of 45° to 90° relative to the base portion 33, according to some aspects at the angle δ of 50° to 80°, and according to further aspects, at the angle δ of about 70°; and a thickness T2 of the flat cutting portion 2 may be between 0.04 mm and 0.11 mm, and according to some aspects about 0.1 mm.

According to some aspects, the flat cutting member 2 may be a blade. The front cutting edge 21 may be exposed via the housing 9. More particularly, the front cutting-edge portion 21 may be exposed via the top portion 11 of the housing 9. The platform portion 31 where the flat cutting portion 2 may be mounted together with the bent portion 32 and the base portion 33 may form the support portion 3. The flat cutting portion 2 may be attached to the support portion 3 by welding techniques or by any other attachment techniques such as stitching, or adhesive. The bent portion 32 may be intermediate to the platform portion 31 and the base portion 33. The base portion 33 may extend downward from the bent portion 32.

The invention claimed is:

1. A shaving cartridge comprising:

at least two cutting members, each of the at least two cutting members including:

a flat cutting portion having a front cutting-edge and a rear end opposite to the front cutting-edge;

a base portion; and a bent portion positioned between the flat cutting portion and the base portion;

the front cutting-edge being adjacent to and projecting from the bent portion, wherein an angle between the base portion and the flat cutting portion is between 50° and 80° while the base portion is perpendicular to a shaving plane, wherein the shaving plane is an imaginary plane that is tangent to the front cutting-edge, wherein a thickness of the flat cutting portion is between 0.04 mm and 0.11 mm and a radius of curvature of the bent portion is between 0.1 mm and 0.3 mm.

2. The shaving cartridge according to claim 1, wherein the cutting member includes a platform portion having an end portion;

the platform portion extending towards the bent portion and being made out of one single piece of material with the bent portion and the base portion;

the flat cutting portion being mounted to the platform portion such that the end portion of the platform portion is adjacent to the rear end of the flat cutting portion.

3. The shaving cartridge according to claim 2, wherein the platform portion is between 0.2 mm and 1.5 mm in length from the end portion to the bent portion; and wherein the platform portion together with the bent portion and the base portion form a support portion for the flat cutting portion.

4. The shaving cartridge according to claim 1, wherein the flat cutting portion is made out of one single piece of material with the bent portion and the base portion.

5. The shaving cartridge according to claim 4, wherein a thickness of the single piece of material of the flat cutting portion, the bent portion, and the base portion is between 0.07 mm and 0.18 mm.

6. A shaving cartridge comprising:

at least two cutting members, each of the at least two cutting members including:

a front cutting-edge, a platform portion, a base portion, and a bent portion;

the platform portion extending towards the bent portion;

the base portion extending downward away from the bent portion and the platform portion;

the bent portion extending between the platform portion and the base portion, such that the front cutting-edge is adjacent to and projects from the bent portion, wherein an angle between the base portion and a flat cutting portion is between 50° and 80° while the base portion is perpendicular to a shaving plane, wherein the shaving plane is an imaginary plane that is tangent to the front cutting-edge, wherein a thickness of the flat cutting portion is between 0.04 mm and 0.11 mm and a radius of curvature of the bent portion is between 0.1 mm and 0.3 mm.

7. The shaving cartridge according to claim 6, wherein the blade support has a thickness of 0.07 mm to 0.18 mm.

8. A process for manufacturing a shaving cartridge comprising:

forming each of at least two cutting members to include a flat cutting portion having a front cutting-edge portion and a rear portion opposite the front cutting-edge portion, a base portion and a bent portion between the flat cutting portion and the base portion;

wherein the front cutting-edge is adjacent to and projecting from the bent portion; wherein the base portion and the flat cutting portion have an angle of between 50° and 80° therebetween while the base portion is perpendicular to a shaving plane, wherein the shaving plane is an imaginary plane that is tangent to the front cutting-edge, wherein a thickness of the flat cutting portion is between 0.04 mm and 0.11 mm and a radius of curvature of the bent portion is between 0.1 mm and 0.3 mm.

9. The process according to claim 8, further comprising the steps of:

forming a platform portion of the cutting member, the platform portion having an end portion, the platform portion being made out of one single piece of material with the bent portion and the base portion and being formed to extend towards the bent portion; and assembling the flat cutting portion on the platform portion such that the end portion of the platform portion is adjacent to the rear end of the flat cutting portion.

10. The process according to claim 8, wherein the step of forming the cutting member includes:

using a single piece of material having a thickness of between 0.07 mm and 0.18 mm.

* * * * *